United States Patent [19]

Ossi

[11] Patent Number: 4,549,562

[45] Date of Patent: Oct. 29, 1985

[54] PAINT ROLLER CLEANING APPARATUS

[76] Inventor: James M. Ossi, 2295 Long Ridge Rd., Stamford, Conn. 06903

[21] Appl. No.: 554,948

[22] Filed: Nov. 25, 1983

[51] Int. Cl.[4] ..... B08B 3/02; B44D 3/12; E06C 7/14

[52] U.S. Cl. ..... 134/138; 15/257.06; 134/153; 134/155; 206/15.2; 248/359.1; 285/8; 312/206

[58] Field of Search ..... 134/135, 138, 139, 148, 134/149, 153, 155, 162, 200; 68/213; 15/257.06, 323; 206/15.2, 15.3; 248/359 E; 312/206, 284; 285/8, 309, 310; 134/200

[56] References Cited

U.S. PATENT DOCUMENTS

| | | | |
|---|---|---|---|
| 1,537,797 | 5/1925 | Bunbury | 285/8 |
| 2,659,917 | 11/1953 | Drum . | |
| 2,694,825 | 11/1954 | Touchett et al. . | |
| 2,759,620 | 8/1956 | Pharris . | |
| 2,831,488 | 9/1958 | Anderson | 68/213 X |
| 2,895,154 | 7/1959 | Belcher . | |
| 2,938,368 | 5/1960 | Bixel . | |
| 3,025,205 | 5/1977 | Hawk . | |
| 3,087,190 | 4/1963 | Werner . | |
| 3,133,548 | 5/1964 | Carr . | |
| 3,166,777 | 1/1965 | Frantz | 15/323 |
| 3,472,251 | 10/1969 | Parker, Jr. | 134/138 |
| 3,591,299 | 7/1971 | Pharris . | |
| 3,732,593 | 5/1973 | Habostad . | |
| 3,822,846 | 1/1973 | Jesionowski . | |
| 3,837,035 | 9/1974 | Habostad . | |
| 3,947,135 | 3/1976 | Hawk . | |
| 4,094,431 | 6/1978 | Wheeler . | |
| 4,108,189 | 8/1978 | Claiborne et al. . | |
| 4,164,803 | 8/1979 | Zurawin . | |
| 4,199,836 | 4/1980 | Lovmark . | |
| 4,205,411 | 6/1980 | Cupp et al. . | |
| 4,294,272 | 10/1981 | Klaiber | 68/213 X |
| 4,446,590 | 5/1984 | Kirchner, Jr. et al. | 134/149 X |

FOREIGN PATENT DOCUMENTS

| | | | |
|---|---|---|---|
| 2640 | 3/1932 | Australia | 285/8 |
| 2407578 | 9/1974 | Fed. Rep. of Germany | 134/149 |
| 2041213 | 9/1980 | United Kingdom | 134/138 |
| 2118262 | 10/1983 | United Kingdom | 285/8 |

*Primary Examiner*—Philip R. Coe

*Attorney, Agent, or Firm*—Kramer & Brufsky

[57] ABSTRACT

Apparatus for use in painting and cleaning paint rollers comprises a paint tray and a paint tray lid which can be mounted thereon. The paint tray lid includes a top wall with a pair of side walls and at least one end wall extending therefrom. A paint roller is fastened inside the lid in spaced relationship to the top wall. A water spray manifold inside the lid extends substantially thereacross, and contains a plurality of spaced orifices across its length aimed to direct water evenly across a paint roller fastened in the lid. The force of the water impinging upon the roller causes the roller to rotate, thereby cleaning the roller. Water spraying from the rotating roller cleans the paint tray. One or more separate orifices can be provided to direct water to clean the paint roller bearings. A hose supplies water under pressure to the manifold. A channel formed within the top wall of the lid accommodates and stores the hose when the apparatus is not in use. Ridges extending from one of the side walls of the lid facilitate drainage of water from the assembly. A pair of legs mounted to the bottom of the paint tray double as a clamp to mount the tray to a ladder step.

16 Claims, 12 Drawing Figures

PAINT ROLLER CLEANING APPARATUS

BACKGROUND OF THE INVENTION

The present invention relates to painting, and more particularly to an apparatus for cleaning paint from a paint roller.

Paint trays in which a roller brush or a regular paint brush can be confined and subjected to a force-fed stream of water or a special cleaning solution to clean the brush for subsequent handling and use are known. For example, U.S. Pat. Nos. 3,732,593 and 3,837,035 disclose paint tray assemblies in which a paint roller can be held so that a stream of water from a garden hose can be directed thereon to clean the paint roller. The structures shown in these patents require the use of a separate garden hose and nozzle which must be manually directed at the paint roller to clean the paint therefrom. Further, each of the assemblies shown in these patents requires a discharge port from which water and dissolved paint drains. Such a discharge port can easily become clogged causing the water and paint mixture to back-up in the tray, thereby creating a messy situation. Still further, the assemblies shown in the mentioned patents cause water from the garden hose to be directed at the bottom of the paint roller to be cleaned, thereby reducing the effectiveness of water which sprays off of the rotating roller to clean the inside of the paint tray assembly. In addition, the patented structures use paint tray lids which slide onto the tray. The slide channels and tracks on which the lid slides are likely to become covered with paint, making it difficult, if not impossible, to slide the lid onto the tray.

Other attempts to provide a paint roller cleaning apparatus are shown in U.S. Pat. Nos. 2,938,368, 3,133,548, and 4,108,189 in which a water spray is fanned from a point source which is centered along the length of the roller; U.S. Pat. No. 3,087,190 in which a pull cord is provided to spin a paint roller; and U.S. Pat. No. 2,895,154 which provides a crank assembly for spinning a paint roller.

Means for clamping a paint tray to a ladder are also well known. Examples of such clamps are shown in U.S. Pat. Nos. 2,694,825; 3,822,846; 2,659,917; 2,759,620; 4,094,431; 4,164,803; 4,199,836; and 4,205,411. None of the structures shown in these patents, however, provides a leg on the paint tray having a generally U-shaped channel with a spring loaded finger extending therein for securely clamping to a ladder step. Nor, do the prior patents show such a clamp with a plurality of notches into which the free end of the spring loaded finger can be inserted to adjustably lock the clamp against the ladder step. Still further, the prior patents do not teach the use of burrs projecting from the spring loaded finger and/or the paint tray leg for biting into a ladder step.

Paint trays which include means for mounting the tray to a wall when not in use are shown in U.S. Pat. Nos. 4,025,205; 3,947,135; and 3,591,299. None of the structures shown in these patents utilize paint tray legs as members for mounting the paint tray to a wall.

It would be advantageous to provide a paint roller cleaning apparatus which is self-contained, easy to use without making a mess, and which cleans the paint roller and tray in a manner far superior to prior art structures. Such a paint roller cleaning apparatus should provide a means for fastening a handle-equipped frame-supported paint roller in a lid and in proper position to be cleaned by a water spray impinging thereon and evenly thereacross from the top of the lid in which the roller is mounted. The roller should be spaced from the lid so that it is free to rotate at a high rate of speed in response to the spray of water. Further, the rotation of the paint roller should be such that it throws water therefrom, by centrifugal force, to adequately clean the lid and a paint tray to which the lid is attached, along with the roller frame and handle at the same time the roller is being cleaned.

It would be further advantageous to provide the paint roller cleaning apparatus with at least one orifice aimed to direct water at the end of a paint roller to clean the bearing on which the paint roller rotates.

It would also be advantageous for the self contained unit forming the paint tray lid to include a channel formed therein to accommodate and store the hose which supplies water to the apparatus. The provision of a universal tap connecter coupled to the hose would be helpful to enable the hose to be connected to virtually any type of water faucet.

Also advantageous would be the provision of a plurality of ridges extending from the paint tray lid to raise the lid above the floor of a sink to improve water drainage from the apparatus when in use.

When in use during painting, the paint tray used with the paint roller cleaning apparatus should provide means for clamping the tray to a ladder step. The clamping means should be easy to use and strong enough to support the tray to insure against accidental paint spills. The same clamping means should be useful in mounting the apparatus to a wall when not in use.

It would be further advantageous to mold the paint tray lid from plastic in one piece.

The present invention relates to such an apparatus for use in painting and in cleaning paint rollers.

SUMMARY OF THE INVENTION

In accordance with the present invention, a paint roller cleaning apparatus is provided which comprises a paint tray lid having a top wall with a pair of side walls and at least one end wall extending therefrom. A plurality of clips inside the lid is adapted to hold a handle-equipped frame-supported paint roller in spaced relation to the interior surface of the top wall. A water spray manifold inside the lid extends substantially across the width thereof, and contains a plurality of spaced orifices across its length. The orifices are aimed to direct water evenly across a paint roller held within the lid. The flow of water cleans the roller by dilution of paint on the roller and rotation of the roller. A hose is provided, having one end coupled to the manifold, to supply water under pressure to the manifold.

One or more additional orifices can be provided at the ends of the manifold which are specifically aimed to direct water at the ends of a paint roller held within the lid. The additional orifices serve to clean the bearings on which the paint roller rotates.

A channel formed within the top wall of the lid can accommodate and store the water supply hose when the apparatus is not in use. A universal tap connector can be provided at the end of the hose which is not coupled to the water spray manifold. The tap connector can comprise a rigid frame adapted to fit around a water tap, a hose coupling and resilient washer mounted at one end of said frame, and a hand-operable screw threadedly engaged with and extending through the other end of the frame to clamp a water tap against the resilient washer to dispense water through the hose coupling and into the hose.

A plurality of ridges can be provided which extend outwardly from one of the side walls of the paint tray lid. The ridges serve to raise the paint tray lid above the floor of a sink when the apparatus is sitting on the ridges within a sink. The space created by the ridges facilitates drainage of water and paint from the apparatus when in use.

By mounting the water spray manifold to the top wall of the paint tray lid, water is directed toward a paint roller from the top of the lid. Such an arrangement facilitates, at the same time the roller is being cleaned, the cleaning of the paint tray lid and a paint tray to which the lid is mounted.

The present invention also provides a paint tray having a pair of legs attached to the bottom thereof. Each leg comprises a first arm mounted flat against the tray bottom, a second arm extending generally perpendicularly from an end of the first arm, and a third arm extending generally perpendicularly from the second arm. The first, second and third arms form a generally U-shaped channel. A spring loaded finger extends from the first arm into the channel and toward the second arm. The channel and finger form a clamp which can be used to mount the paint tray to a ladder step. A plurality of notches can be provided in the second arm into which the free end of the spring loaded finger can be inserted to adjustably lock the clamp. The finger can include a burr projecting therefrom adapted to bite into a ladder step to which the leg is clamped. The third arm could also, or alternatively include a burr projecting therefrom adapted to bite into a ladder step to which the leg is clamped.

The paint tray lid can be molded in one piece from plastic and include the means for mounting the lid to a paint tray, the paint roller fastening means, the ridges for holding the assembly above the floor of a sink, and the channel for accommodating the hose.

DETAILED DESCRIPTION OF A PREFERRED EMBODIMENT

Figure 1:
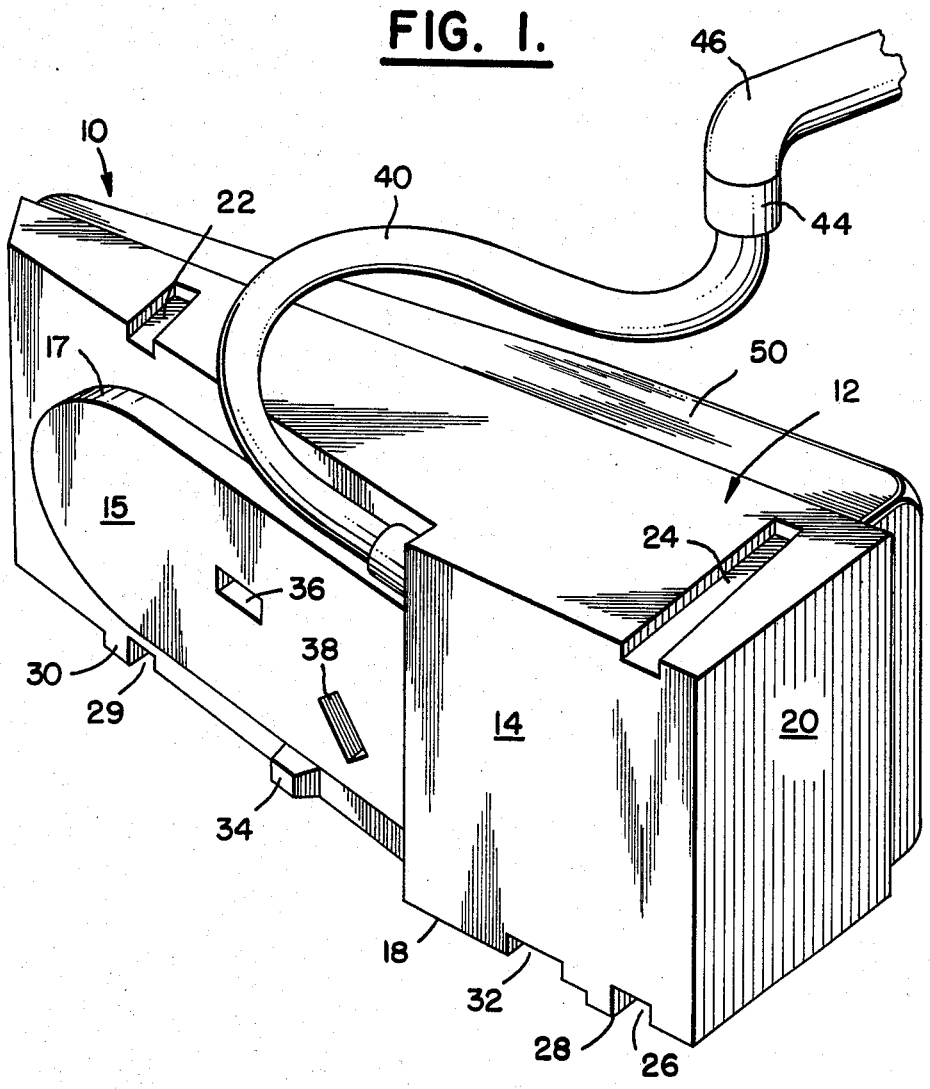
FIG. 1 is a perspective view of the apparatus of the present invention on its side, as in operation, and connected to a water tap.
Figure 4:
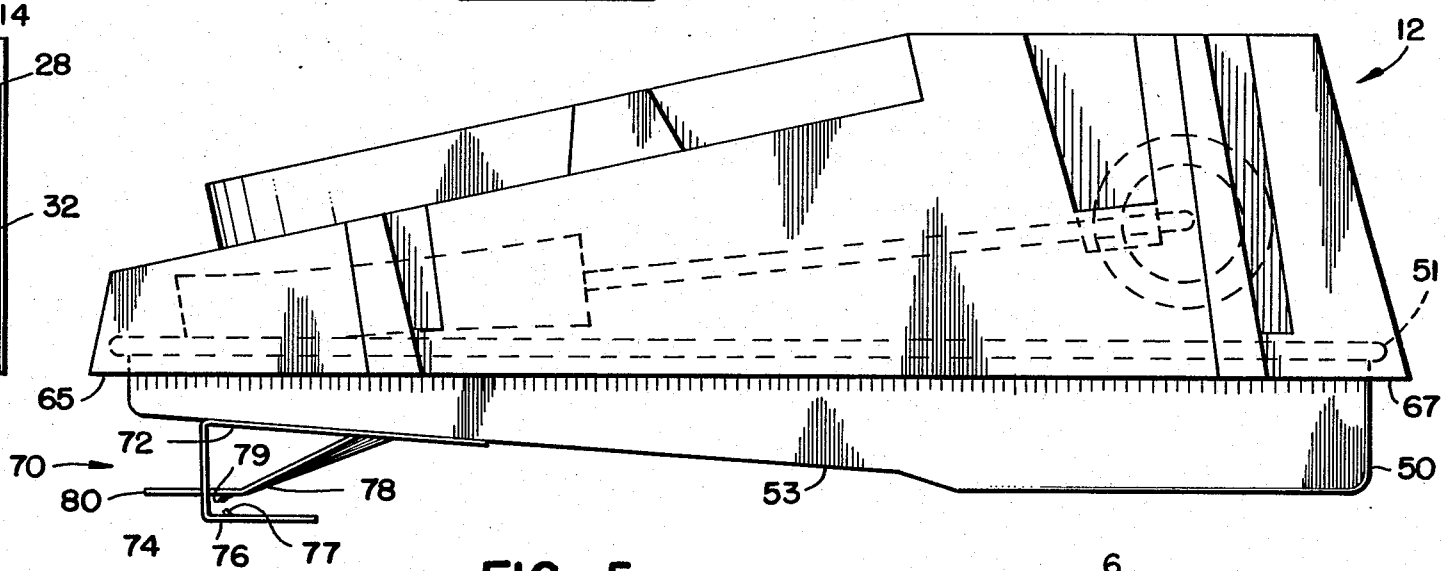
FIG. 4 is a side view of the apparatus of the present invention.

Turning now to the drawings, FIG. 1 shows an apparatus 10 for use in painting and in cleaning paint rollers. Apparatus 10 includes a paint tray lid 12 which is mounted to a paint tray 50. Paint tray 50 is generally conventional in nature, except for legs 70 (see, e.g., FIG. 4) which form a clamp for mounting the tray to a ladder step.

Paint tray lid 12 includes a top wall 14 with a pair of side walls 16 and 18 and at least one end wall 20 extending therefrom. A plurality of clips 32, 36, and 38 inside lid 12 are adapted to hold a handle-equipped frame-supported paint roller 52 in spaced relation to the interior surface of top wall 14, as most clearly shown in FIG. 3. Paint roller 52 is supported on frame 54 by a conventional bearing at 64. A handle 56 mounted to frame 54 is grasped when using the roller to paint a surface. By maintaining paint roller 52 spaced from all interior surfaces of the paint tray lid 12 and paint tray 50, the roller will remain fluffy for future use after it has been cleaned and left to dry.

Figure 6:
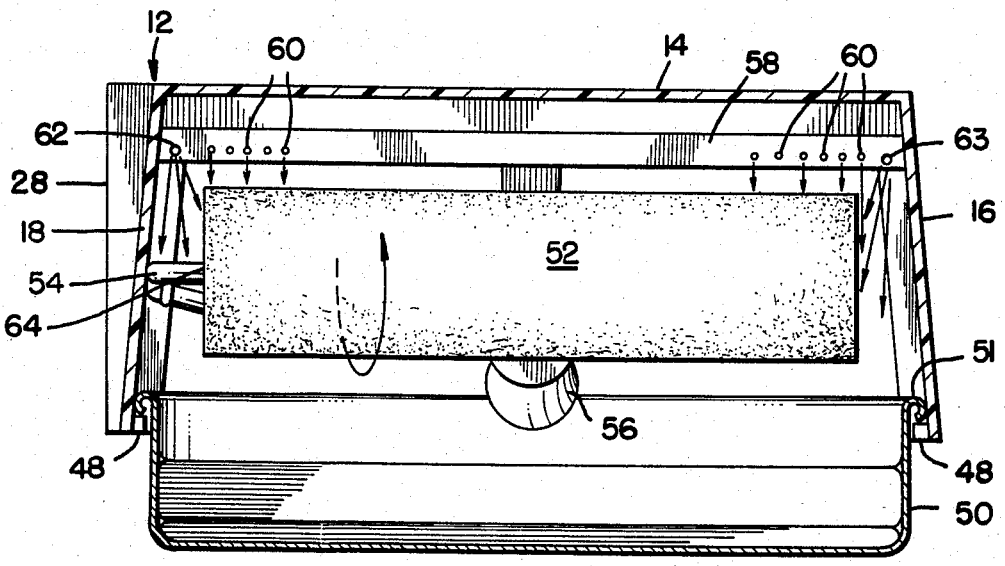
FIG. 6 is a cross sectional view taken substantially along the line 6—6 shown in FIG. 5.
Figure 2:
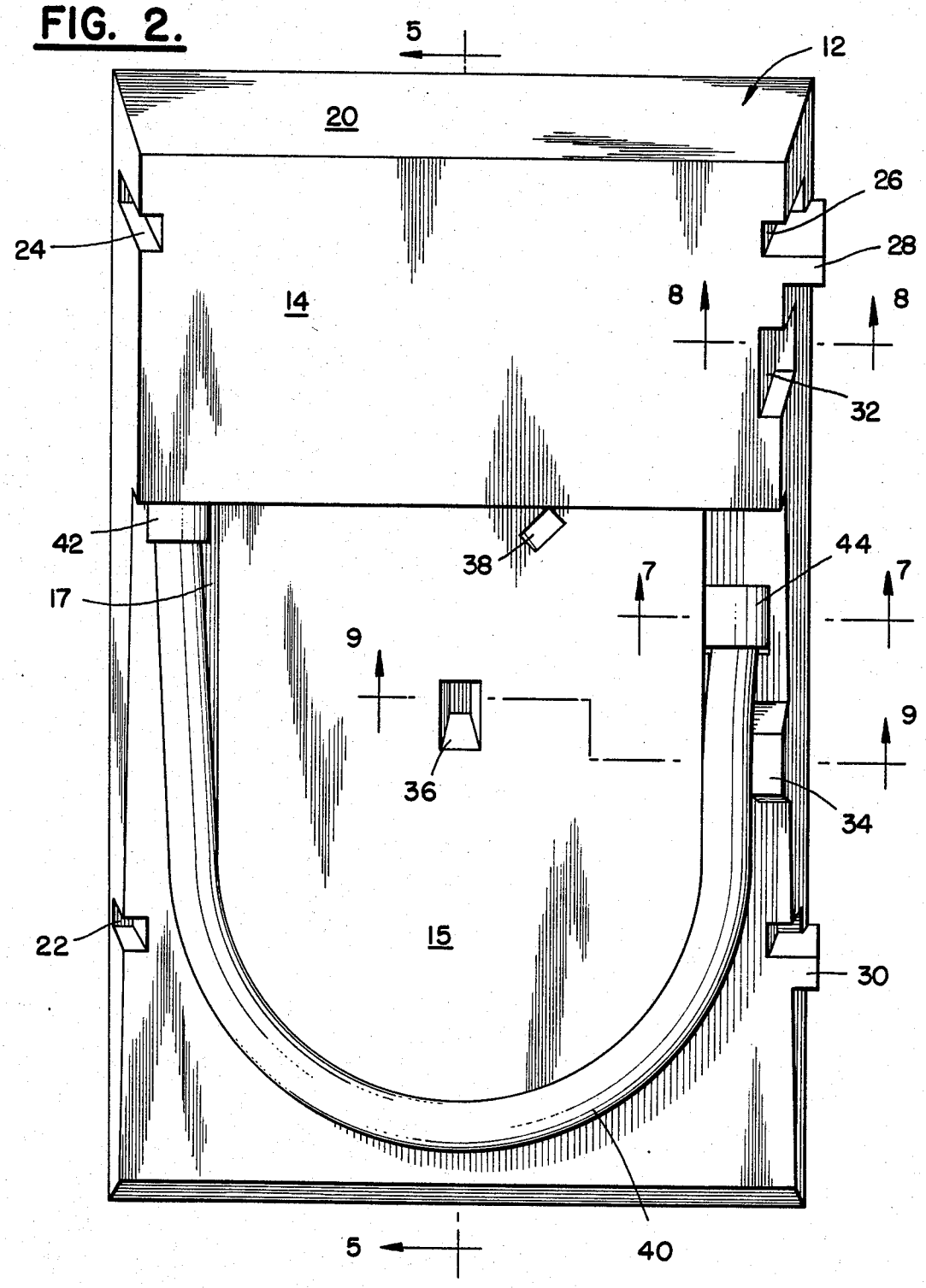
FIG. 2 is a top plan view of the apparatus of the present invention.
Figure 3:
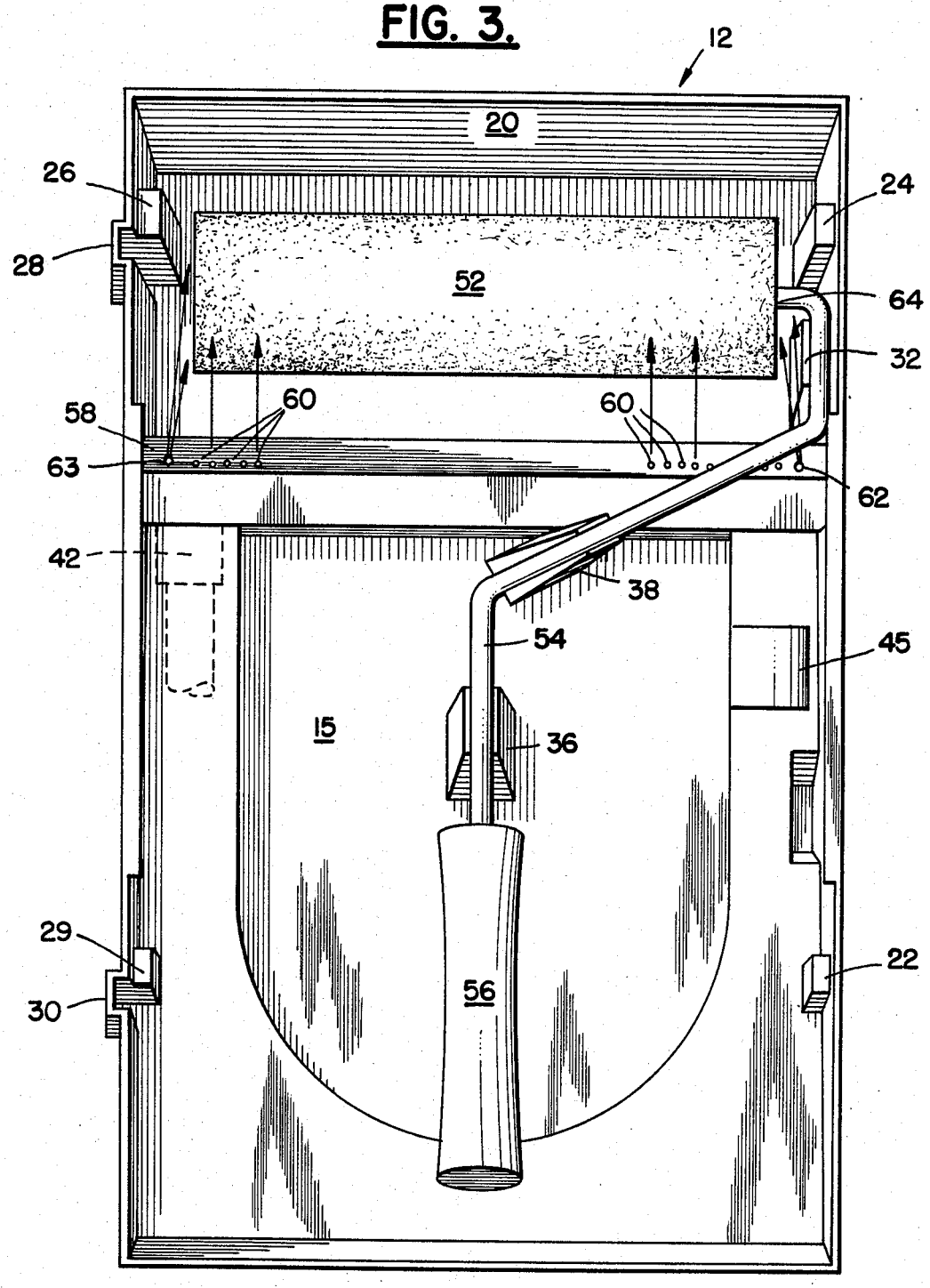
FIG. 3 is a plan view looking into the paint tray lid from the bottom thereof.
Figure 5:
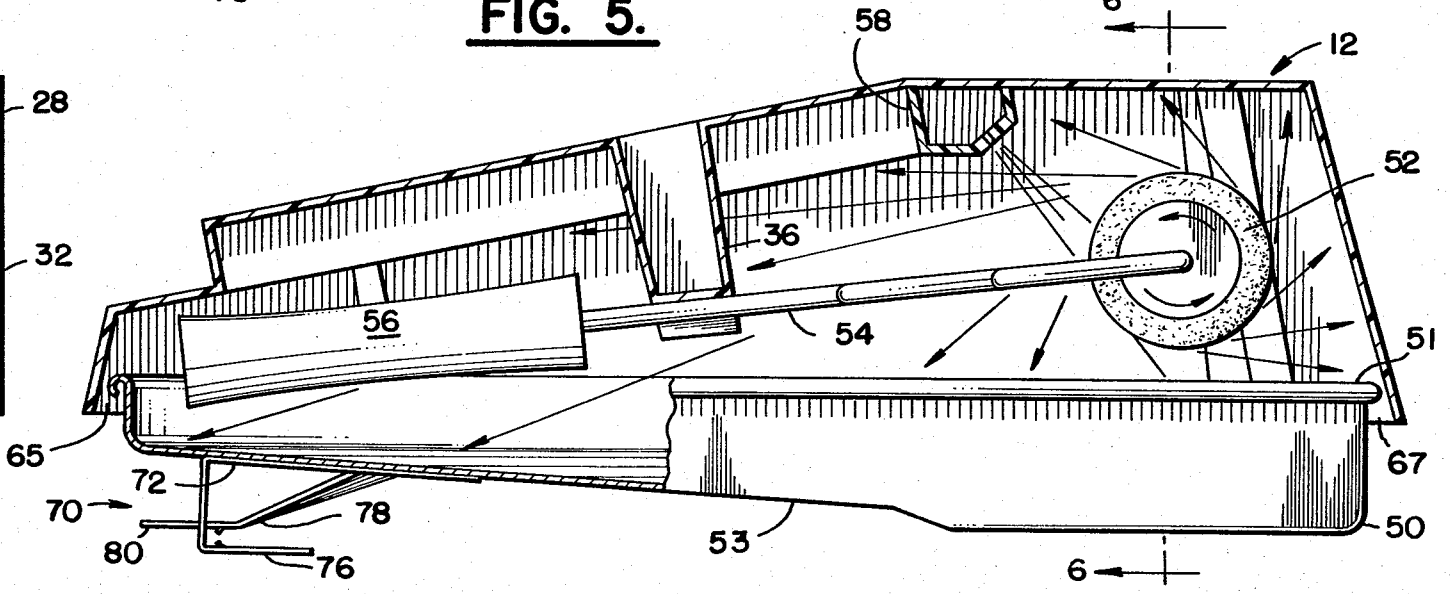
FIG. 5 is a cross sectional view taken substantially along the lines 5—5 shown in FIG. 2.
Figure 7:
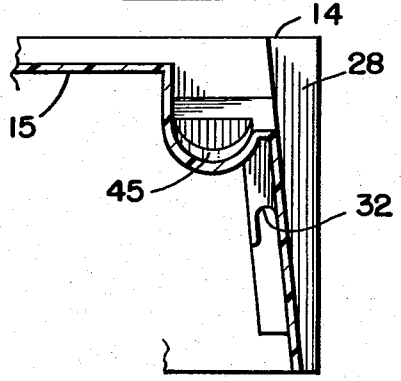
FIG. 7 is a cross sectional view taken substantially along the lines 7—7 shown in FIG. 2.
Figure 8:
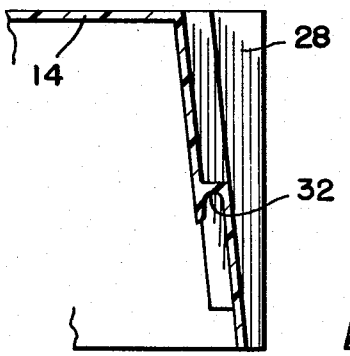
FIG. 8 is a cross sectional view taken substantially along the lines 8—8 shown in FIG. 2.
Figure 9:
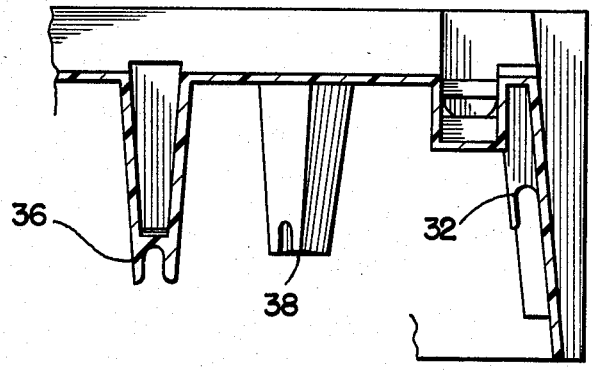
FIG. 9 is a cross-sectional view taken substantially along the lines 9—9 shown in FIG. 2.

A water spray manifold 58 is provided inside of lid 12. As best shown in FIGS. 3 and 6, water spray manifold 58 extends substantially across the width of lid 12, and contains a plurality of spaced orifices 60 across its length. Orifices 60 are aimed to direct water evenly across paint roller 52. In the structure of the present invention, orifices 60 cause water to be sprayed toward the bottom of roller 52, as shown in FIG. 5, to rotate the roller efficiently at a high rate of speed, and to facilitate cleaning of lid 12 and tray 50 along with the cleaning roller 52. The use of this structure also assists in initially starting the rotation of roller 52. Prior art structures for cleaning paint rollers do not use a water spray manifold having a plurality of spaced orifices across their length. Instead, the prior art devices spray water from a single source centered with respect to the length of the roller. In some instances, the water in such prior art arrangements is caused to fan out to cover the length of the roller. However, since the water is not sprayed evenly across the roller in such prior art structures, the structures do not satisfactorily start the rotation of paint rollers which are heavily laden with paint. The structure of the present invention does not suffer from this problem.

Water spray manifold 58 includes an additional orifice 62 which is aimed to direct water at the end of paint roller 52 to clean the bearing at 64 on which the paint roller rotates. A further orifice 63 can be provided to clean the bearing at the other end of paint roller 52. It is important to keep the bearing on which the paint roller rotates clean for future use.

Paint tray lid 12 is adapted to snap onto tray 50 through the use of edges 48 on side walls 16 and 18 which snap over bead 51 of paint tray 50. Indentations 22, 24, 26 and 29 establish a stop surface which limits the distance into which tray 50 can project into lid 12.

A hose 40, connected through coupling 44 to faucet or tap 46 is used to provide water, under pressure to water spray manifold 58. Hose 40 is coupled to manifold 58 through a coupling 42 in paint tray lid 12. A portion 15 of the top wall of paint tray lid 12 projects upwardly to form a channel 17 around which hose 40 can be accommodated and stored when the apparatus 10 is not in use. Clip 34 extends from the top wall 14 of paint tray lid 12 to secure hose 40 within channel 17. Recess 45 is provided in top wall 14 to accommodate coupling 44 of hose 40 when the apparatus is not in use.

Also included in paint tray lid 12 are ridges 28 and 30 which extend from side wall 18 thereof. Ridges 28 and 30 serve to raise the paint tray lid 12, and thus assembly 10, above the floor of a sink when paint tray lid 12 is sitting on ridges 28 and 30 within a sink. The assembly fits ia a conventional sink better when it sits on its side as shown in FIG. 1. Ridges 28 and 30 enable water and paint, which is discharged from assembly 10 when a roller is being cleaned, to flow under paint tray lid 12 to the sink drain. When in use, water and paint will be discharged from assembly 10 through openings 65 and 67 (see FIGS. 4 and 5) formed from the overlap of the end walls of paint tray lid 12 over paint tray 50.

Referring now to FIG. 5, the operation of the present apparatus will be explained. FIG. 5 is a cross sectional view which shows roller 52 mounted within paint tray lid 12, and paint tray lid 12 mounted on paint tray 50. FIG. 5 also shows, by dashed lines, the spray of water from manifold 58 toward roller 52. The water spray impinges upon roller 52, and causes it to rotate counterclockwise as shown by the arrows in the drawing. It has been found that by orienting the water spray as shown, the cleaning of the paint tray 50 and paint tray lid 12, particularly at the end thereof farthest from paint roller 52, is dramatically improved. It is believed that this result occurs because water from roller 52 will be thrown therefrom by centrifical force toward the remote areas of the paint tray and paint tray lid from the top of roller 52. If the orifices in water spray manifold 58 were oriented instead to direct water at the other side of roller 52, the roller would rotate clockwise and water thrown off of the bottom of roller 52 would have a harder time reaching the remote areas of the assembly.

Figure 10:
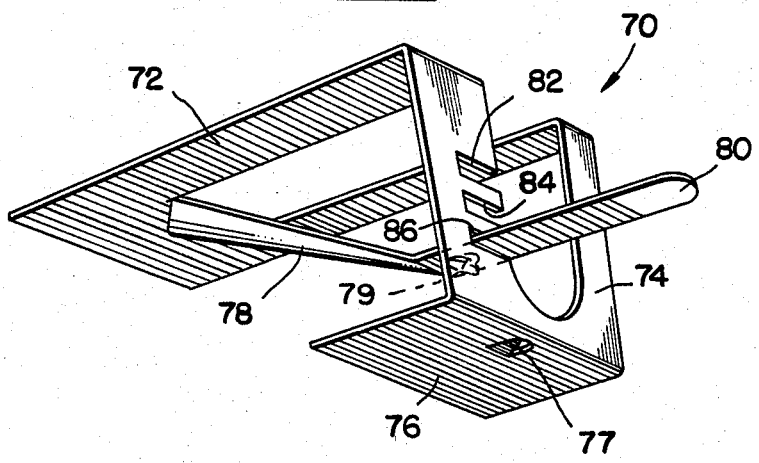
FIG. 10 is an enlarged perspective view showing the paint tray leg assembly.

Paint tray 50 includes legs 70 which each comprise a first arm 72 mounted flat against the bottom 53 of tray 50. Each leg 70 also includes a second arm 74 extending generally perpendicularly from an end of first arm 72, and a third arm 76 extending generally perpendicularly from second arm 74. First arm 72, second arm 74, and third arm 76 form a generally U-shaped channel which, in conjunction with a spring loaded finger 78 provides a clamp to mount tray 50 to a ladder step. Spring loaded finger 78 extends from first arm 72 into the U-shaped channel and toward second arm 74. As shown in FIG. 10, a series of notches 82, 84, and 86 can be provided in second arm 74 into which the free end 80 of finger 78 can be inserted to adjustably lock the clamp to a ladder step. Further, spring finger 78 and/or third arm 76 can comprise burrs 77 and/or 79 projecting therefrom and adapted to bite into a ladder step to which legs 70 are clamped.

Figure 11:
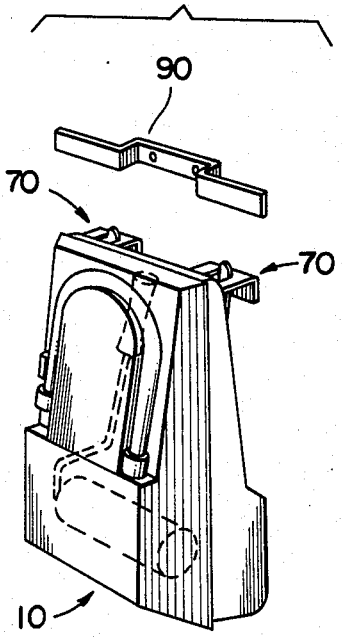
FIG. 11 is a prespective view showing a clamp for hanging the assembly of the present invention on a wall.

As shown in FIG. 11, a mounting bar 90 can be provided for mounting to a wall. Mounting bar 90 is shaped so that legs 70 of assembly 10 can be hung thereon for mounting to a wall when the painting and roller cleaning apparatus is not in use. Mounting bar 90 is designed such that the apparatus cannot be knocked off of a wall by a blow from the side.

Figure 12:
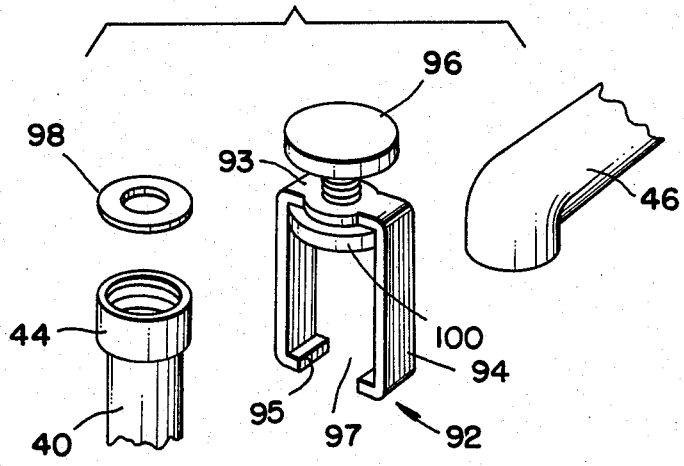
FIG. 12 is an exploded view of a universal tap connector.

FIG. 12 shows a universal tap connector which can be used to couple hose 40 to a faucet or tap which is not threaded to accept threaded hose coupler 44. Universal tap connector 92 comprises a rigid frame 94 adapted to fit around a water tap 46. Hose coupling 44 and a resilient washer 98 are mounted at one end 95 of frame 94 by insertion into slot 97. Resilient washer 98 can, for example, be fabricated from rubber or plastic. A hand-operable screw 96 is threadedly engaged with and extends through the other end 93 of frame 94 to clamp water tap 46 against resilient washer 98. When universal tap connector 92 is installed on tap 46, water is dispensed from the tap through resilient washer 98 and hose coupling 44 into hose 40.

Although the invention has been described in connection with a preferred embodiment, the scope of the invention is not intended to be limited to the particular forms set forth herein. It is intended to cover such alternatives, modifications and equivalents as may be included within the spirit and scope of the invention as defined by the appended claims.

I claim:

1. Paint roller cleaning apparatus comprising:

a unitary paint tray lid having a top wall of a size for substantially covering a paint tray and with a pair of side walls and at least one end wall extending therefrom;

a plurality of clips inside said lid adapted to hold a handle-equipped frame-supported paint roller in spaced relation to the interior surface of said top wall;

a water spray manifold mounted inside said lid and extending substantially across the width thereof, said manifold containing a plurality of spaced orifices across its length aimed to direct water evenly across a paint roller held within said lid; and a hose having one end thereof coupled to said manifold to supply water to said manifold under pressure.

2. The apparatus of claim 1 further comprising at least one additional orifice at an end of said manifold specifically aimed to direct water at the end of a paint roller held within said lid to clean the bearing on which the paint roller rotates.

3. The apparatus of claim 1 further comprising a channel formed within the top wall of said lid to accomodate and secure said hose when the appartus is not in use.

4. The apparatus of claim 1 further comprising a universal tap connector coupled to the other end of said hose, said tap connector comprising:

a rigid frame adapted to fit around a water tap;

a hose coupling and resilient washer mounted at one end of said frame; and a hand-operable screw threadedly engaged with and extending through the other end of said frame to clamp a water tap against said resilient washer to dispense water through said hose coupling and into said hose.

5. The apparatus of claim 1 further comprising a plurality of ridges extending outwardly from one of said side walls to raise said paint tray lid above the floor of a sink when sitting on said ridges within a sink.

6. The apparatus of claim 1 wherein said manifold is mounted to said top wall so as to direct water toward a paint roller from the top of the lid.

7. Apparatus for use in painting and cleaning paint rollers comprising:

a paint tray;

unitary paint tray lid means having a top wall with a pair of side walls and at least one end wall extending therefrom for covering substantially the entire paint tray;

means for mounting said lid to cover said tray;

means for fastening a handle-equipped frame-supported paint roller inside said lid in spaced relation to said top wall;

a water spray manifold inside said lid and extending substantially across the width thereof, said manifold containing a plurality of spaced orifices across its length aimed to direct water evenly across a paint roller fastened to said lid; and a hose having one end thereof coupled to said manifold to supply water under pressure to said manifold.

8. The apparatus of claim 7 further comprising a pair of legs attached to the bottom of said paint tray, each leg comprising:

a first arm mounted against the tray bottom;

a second arm extending generally perpendicularly from an end of said first arm;

a third arm extending generally perpendicularly from said second arm, said first, second and third arms forming a generally U-shaped channel; and a spring loaded finger extending from said first arm into said channel and toward said second arm;

whereby said channel and finger form a clamp to mount said tray to a ladder step.

9. The apparatus of claim 8 wherein said second arm includes a plurality of notches into which the free end of said finger can be inserted to adjustably lock said clamp.

10. The apparatus of claim 8 wherein said finger includes a burr projecting therefrom adapted to bite into a ladder step to which said leg is clamped.

11. The apparatus of claim 8 wherein said third arm includes a burr projecting therefrom adapted to bite into a ladder step to which said leg is clamped.

12. The apparatus of claim 7 further comprising at least one additional orifice at an end of said manifold specifically aimed to direct water at the end of a paint roller held within said lid to clean the bearing on which the paint roller rotates.

13. The apparatus of claim 7 further comprising a plurality of ridges extending outwardly from one of said side walls to raise said paint tray lid above the floor of a sink when sitting on said ridges within a sink.

14. The apparatus of claim 13 further comprising a channel formed within the top wall of said lid to accomodate and store said hose when the apparatus is not in use.

15. The apparatus of claim 14 wherein said paint tray lid is one piece molded from plastic and includes said lid mounting means, said paint roller fastening means, said ridges, and said channel.

16. The apparatus of claim 15 wherein said manifold is connected to the top wall of said paint tray lid so as to direct water toward a paint roller from the top of the lid.

* * * * *